US005257810A

United States Patent [19]

Schorr et al.

[11] Patent Number: 5,257,810

[45] Date of Patent: Nov. 2, 1993

[54] METHOD OF PLAYING A BLACKJACK TYPE CARD GAME

[76] Inventors: Steven A. Schorr, P.O. Box 2734, Stateline, Nev. 89449; Frank M. King, P.O. Box 13840, So. Lake Tahoe, Calif. 95702

[21] Appl. No.: 889,523

[22] Filed: May 27, 1992

[51] Int. Cl.[5] ..... A63F 1/00

[52] U.S. Cl. ..... 273/292; 273/274; 273/309

[58] Field of Search ..... 273/292, 274, 309

[56] References Cited

U.S. PATENT DOCUMENTS 5,072,946 12/1991 Miller ..... 273/292

OTHER PUBLICATIONS

Scarne's Encyclopedia of Games, by Johe Scarne, Harper & Row Publishers, 1973, pp. 276-287.

*Primary Examiner*—Benjamin H. Layno
*Attorney, Agent, or Firm*—Flehr, Hohbach, Test, Albritton & Herbert

[57] ABSTRACT

A method for playing a blackjack type game including a "Dealer Hand" and a common "Player Hand". At least one Customer wagers a first bet on any one of a Dealer betting station corresponding to the "Dealer Hand", a Player betting station corresponding to the Common "Player Hand", and a tie betting station corresponding to a tie between the "Dealer Hand" and the Common "Player Hand". The object of the game is to wager on the winning hand. The Dealer executes play of both the Common "Player Hand" and the "Dealer Hand" in accordance with a predetermined set of rules. If the at least one Customer has wagered on a winning station, the Customer wins. Thus, the Customer wagers on the outcome of the blackjack game without actually participating in the card play.

35 Claims, 1 Drawing Sheet

METHOD OF PLAYING A BLACKJACK TYPE CARD GAME

TECHNICAL FIELD

The present invention relates to casino or cardroom gaming, and more particularly, to a method of playing a blackjack type card game.

BACKGROUND ART

The game of "Blackjack" or "21" is arguably the most popular casino game offered by gambling establishments. Blackjack has fascinated the public for years as a leisure time activity, or as a means of income for some individuals. Each year billions of dollars in wagers are traded over the table in connection with this one game alone.

Typically, in Blackjack, each Player wagers a bet and is dealt two cards by a Dealer who also deals two cards to himself. To win, the Player's cards must have a total card value higher than that of the Dealer, but no greater than twenty-one.

The "Dealer Hand" is played out by the Dealer, in accordance with a set of predetermined "house rules", such as the "Northern Nevada" rules now practiced at HARRAH'S ® Casino. These rules control the play of the Dealer's Hand with respect to when drawing subsequent cards. However, the Player's Hand, in a typical Casino Blackjack game, is played out according to the individual Player's choice. Thus, each Player has his own option to "hit" (draw a card) or "stand" (not draw a card) in his effort to reach twenty-one with respect to their card hand. Thus, to some extent, the Players can increase or decrease their probability of success against the Dealer.

Although the Players are not bound to "hit" or "stand" at certain card situations, a general set of "common rules" apply which are generally known to those familiar with the game. By "hitting" or "standing" in certain card situations, the individual Player may substantially increase their probability of beating the Dealer.

Unlike some card games, Blackjack is an ideal gambling establishment card game because all the Players oppose the Dealer (or "house") rather than each other. Thus, more revenue may be generated, as opposed to card games which generate revenue by merely acting as the "house", such as "poker". However, one problem associated with the typical Casino Blackjack game is that the game itself is relatively slow to develop. The Dealer may have to deal to as many as seven Players not including the Dealer. Furthermore, each Player has to make the individual decision whether to "hit" or "stand" on their own card hand. This is especially time consuming when the Player is indecisive. Accordingly, the pace is not fast enough for some individuals, and in addition, may reduce the potential revenue for both a Player and the gambling establishment.

Another problem associated with the typical Casino Blackjack game is that those unfamiliar with the game reduce their probability of success by electing to "hit" or "stand" at inappropriate or inopportune times. Such inexperienced play may potentially affect the other Players surrounding the inexperienced Player. For example, the inexperienced Player may draw a card which hurts not only themselves, but may also hurt the other Player's at the table. In the worst case scenario, the Player's inexperienced play may help the Dealer.

This is especially imperative, should the inexperienced Player be positioned at the "third base" position (i.e., the positioned just before the Dealer) . Such inexperienced play may dictate whether the Dealer "busts" (i.e., surpasses twenty-one) which, not surprisingly, will immensely aggravate the other Blackjack Players.

Accordingly, inexperienced Players may shy away from playing Blackjack or be intimidated from increasing their wager due to their card gaming ignorance or improper playing strategy. Often, first time or inexperienced gamblers refuse to participate in the game for fear of losing money, and/or for fear of embarrassment. Therefore, they are relegated to being mere observers. Moreover, one bad experience may forever intimidate them from playing again. It is for these Players that initial playing experience may not provide a proper vehicle for learning the game.

Moreover, some potential Players may be intimidated from playing the game because they are not good at mathematics. Thus, they fear being embarrassed by not adding fast enough or by adding their cards incorrectly in which they may inappropriately draw another card or the like.

Accordingly, it is an object of the present invention to provide a method of playing a blackjack type game which acts as a learning vehicle for playing a blackjack type game.

It is a further object of the present invention to provide a method of playing a blackjack type game which reduces Player involvement so that they may enjoy the game without concern for proper playing strategy.

Another object of the present invention is to provide a method of playing a blackjack type game which allows the Player to bet on the "Dealer Hand".

Yet another object of the present invention is to provide a method of playing a blackjack type game which increases the pace of the game.

Still another object of the present invention is to provide a method of playing a blackjack type game which increases the participation and interest in the game to an inexperienced Player.

Still a further object of the present invention is to provide a method of playing a blackjack type game which increase potential revenue by increasing the pace of the game.

It is a further object of the present invention to provide a method of playing a blackjack type game which is easy and fun to play by unskilled personnel.

The apparatus of the present invention has other objects and features of advantage which will be more readily apparent from the following description of the best mode of carrying out the invention and the appended claims, when taken in conjunction with the accompanying drawing.

Accordingly, there has been a need for a Blackjack type game which permits Customer participation in the game without the additional pressure of play making decisions. The present invention meets this need.

DISCLOSURE OF INVENTION

A method of playing a blackjack type card game of the present invention, including a "Dealer Hand" and a common "Player Hand", comprises, briefly, the steps of at least one Customer wagering a first bet on any one of a Dealer betting station corresponding to the "Dealer Hand", a Player betting station corresponding to the common "Player Hand", and a tie betting station corresponding to a tie between the "Dealer Hand" and the common "Player Hand". A Dealer dealing an initial hand of blackjack to each common "Player Hand" and "Dealer Hand". The Dealer playing each the common "Player Hand" and the "Dealer Hand" in accordance with a predetermined set of rules. If the Customer has wagered on a winning station, the Customer wins a first preselected amount based on the Customer's first bet.

The present invention permits betting on the outcome of the blackjack game without actually participating in the card play. Accordingly, the pace of the game is substantially increased.

BEST MODE OF CARRYING OUT THE INVENTION

Figure 1:
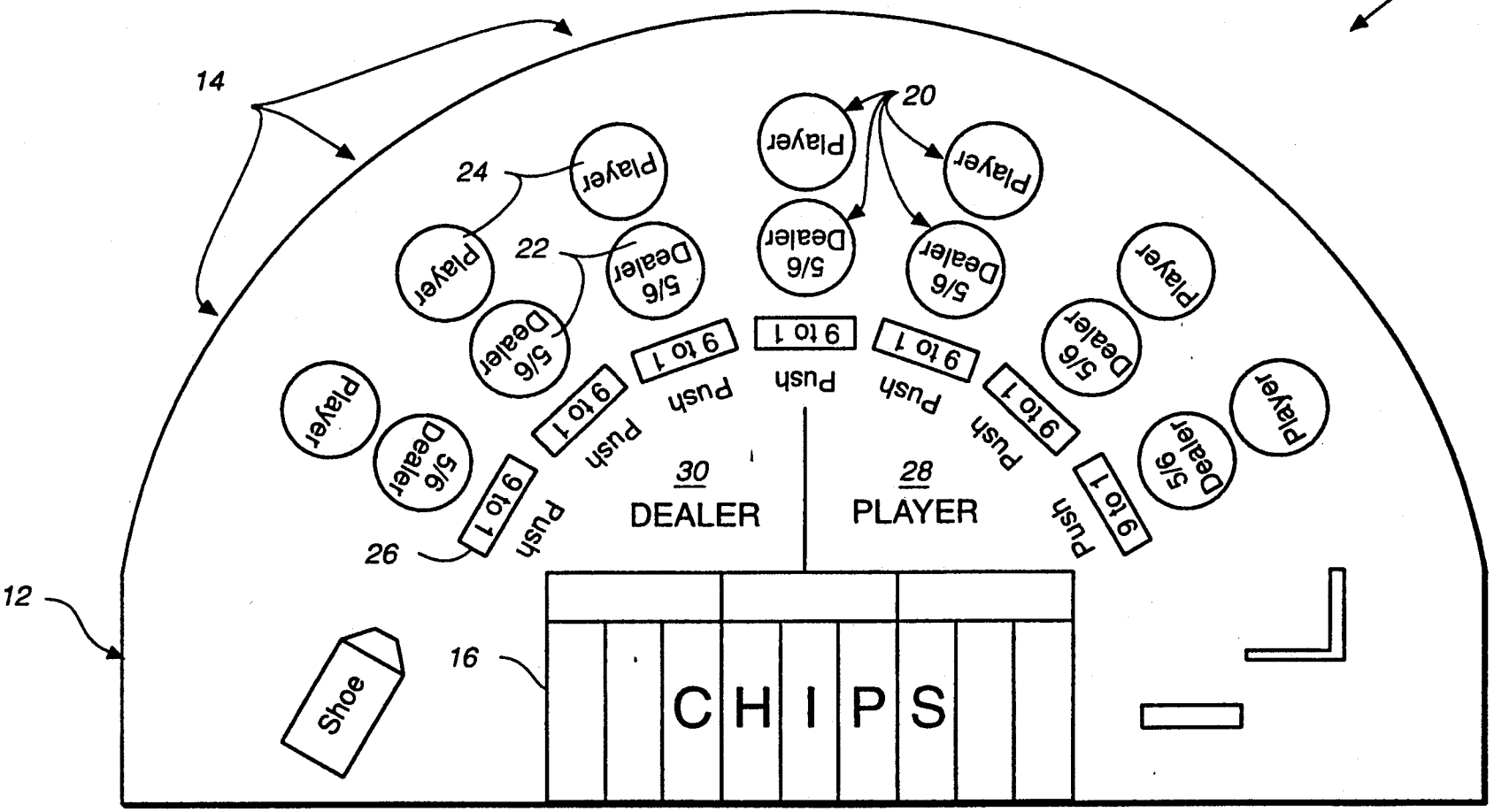
FIG. 1 is a top plan view of a card table incorporating a blackjack type game as described in accordance with the present invention.

Reference will now be made in detail to the preferred embodiments of the invention. While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

In accordance with the method of the present invention, briefly, a game of "Blackjack" is played out only by a Dealer whom plays the game in accordance with a predetermined set of rules which will be discussed in more detail below. The version of the present invention to be employed at gambling establishments, hereinafter referred to as "Gambler's Choice", will be described with reference to the gaming table 10, illustrated in FIG. 1. As used in this description, the "House" is referred to as the gambling establishment and acts as the banker. The House collects all losing wagers and pays all winning wagers to the Players or Customers. The Dealer is employed by the House to deal the cards and each Customer plays exclusively against the House.

In the preferred form, only two card hands will be dealt out by the Dealer which are generally referred to as a "Dealer Hand" and a common "Player Hand". It will be appreciated, however, that more than one common "Player Hand" may be dealt without departing from the true spirit and nature of the present invention. A prospective "Customer", as distinguished from the "Player Hand", will have their option of wagering a "primary" or "first" bet on at least one of the "Dealer Hand", the "Player Hand" or on a tie between the "Dealer Hand" and the "Player Hand". In the most basic assessment of the Gambler's Choice Blackjack game, the object of the game is to wager on the winning hand.

Unlike a typical "Casino Blackjack" game, a Customer is not a Player of the card game in the sense of making strategic or card playing decisions during the course of the game. That is, the Customer of the present invention does not control the destiny of his card hand by not participating in the "hit" or "stand" decisions. These are determined by a set of predetermined rules, described below, which are executed by the Dealer.

Attention is now directed to FIG. 1, where the subject method of playing a Blackjack type card game in accordance with the present invention is preferably played on. Briefly, gaming table, generally designated 10, includes a playing surface 12 which defines a plurality of playing locations, generally designated 14. In the preferred form, as illustrated in FIG. 1, seven playing locations 14 are radially positioned about a token rack 16 which, in turn, is positioned in front of a Dealer's playing location 18. The token rack, of a conventional design, holds playing chips of a typical gambling denominations. It will be appreciated, however, that the number of playing locations 14 may be more or less than seven.

Each playing location 14 includes a betting station, generally designated 20, and each having three betting circles: a Dealer betting stations 22 corresponding to bets placed on the "Dealer Hand"; a Player betting stations 24 corresponding to bets placed on the "Player Hand"; and a tie betting stations 26 corresponding to bets placed on a tie between the "Dealer Hand" and the "Player Hand". These separate betting circles 20 for each Player location 14 clearly illustrate the station where the Customer has placed their wager. As viewed in FIG. 1, playing surface 12 also includes a "Player Hand" placement area 28 and a "Dealer Hand" placement area 30 which represents the placement areas of the respective hands during the course of the game.

The House, of course, has a distinct advantage over a Customer in the typical Casino Blackjack game. Most gambling establishments would not succeed otherwise. This advantage would persuade constant wagering on the "Dealer Hand" rather than wagering on the "Player Hand". Hence, in accordance with the present invention, the Customer's betting on the "Dealer Hand" will have to assume the risks associated with the Dealer. Accordingly, the payout is adjusted so that the House is compensated whether the Customer wagers on the "Player Hand" or the "Dealer Hand". Otherwise, those familiar with the game would probably always bet on the "Dealer Hand".

For example, upon every winning bet placed on the "Dealer Hand", the "House" or Casino may impose a commission as compensation. In the preferred embodiment, Customers betting on the "Dealer Hand" will bet 6-to win-5 or 5-to-6. This will persuade Customers to place bets on the other alternatives as well. Similarly, because the odds against having a tie are substantial, the payout may be adjusted accordingly. In the preferred form, the payout odds for a tie are 9-to-1 while wagers on the "Player Hand" are 1-to-1 or even money. These percentages or formulations may vary of course.

As mentioned above, before the onset of Gambler's Choice Blackjack, the Customers must determine whom to place their First wager on: the "Dealer Hand"; the common "Player Hand"; a tie between the "Dealer Hand" and the common "Player Hand"; or a combination thereof. Once the Customer has wagered his first bet, the Dealer may deal an "Initial Player Hand" and an "Initial Dealer Hand" to their respective placement areas 28 and 30.

Briefly, the playing cards may comprise standard playing cards and Gambler's Choice Blackjack may be played with a single deck or multiple decks. Moreover, a card shoe may be employed if desired. Many of the typical Casino Blackjack rules apply to Gambler's Choice Blackjack. For instance, being initially dealt, in any order and in any suit, an Ace and either a 10 or a Face Card constitutes a "Blackjack" which includes a payout of 3-to-2 on the Player side only. "Dealer Hands" receiving a Blackjack are paid 1-to-1.

After the initial hands have been dealt, the Dealer may only "hit" or "stand" with respect to either the "Dealer Hand" or the "Player Hand", in accordance with the following predetermined rules to be discussed below. Thus, the inexperienced Blackjack gambler may wager on the outcome of the game without the fear or intimidation of making an improper play or strategic move. Moreover, these rules may act as training guidelines which teach an inexperienced Player the basic underlying rules which increase their probability of successful play. Because the Customer makes no decisions, other than deciding where to wager their bet and whether to split or double down as will be discussed below, they do not have to strategically think and may merely observe while still participating.

Moreover, the tempo of the Gambler's Choice Blackjack game, in accordance with the present invention, may be substantially increased as compared to the typical Casino Blackjack game. The number of hands may be minimized to a "Dealer Hand" and a single "Player Hand" as opposed to multiple "Player Hands". Because, all "hit" and "stay" decisions are to be executed by the Dealer in accordance with predetermined rules, individual Player indecision and misplay do not become a factor in slowing the pace of the game. More importantly, although only one "Player Hand" is dealt, as many as seven bettors, preferably, may still participate in the game. Accordingly, this increased pace may substantially increase potential revenue for both the House and the individual Customers.

In order to uniformly play Gambler's Choice Blackjack, the Dealer must abide by certain predetermined guidelines or set of rules which aid or control the game. As with normal Casino Blackjack, the "Dealer Hand" is to have one card facing up while the remaining card is facing down. Hence, the direction of the game will be dictated by the value of the Dealer's upcard. Because the "Player Hand" does not control the initial direction of the game, both these cards are preferably dealt face up.

In accordance with the method of the present invention, the following predetermined Player "hit" and "stand" rules are to apply to the "Player Hand". These predetermined rules, as set forth in TABLE 1, are dictated by the Dealer's upcard and are to be executed by the Dealer only.

TABLE 1

| Dealer's Up Card | Player will "hit" to: |
|---|---|
| 2, 3, 4, 5 and 6 | Hard 12 |
| 7, 8, 9, 10, Face card and Ace | Hard 17 or Soft 18 |

Briefly, the terms "hard" and "soft" are derived from the Casino Blackjack game and are to retain their original meaning. In Casino Blackjack, an Ace may have a card value of either "one" or "eleven". The term "soft" hand refers to card hands including at least one Ace, where: the Ace may have a card value of either "one" or "eleven"; and the cumulative hand value does not surpass "twenty-one". A "hard" hand, by comparison, is a hand which either: does not include an Ace; or includes at least one Ace but should the Ace retain a value of "eleven", the cumulative hand value would exceed twenty-one. For instance, a hand dealt an Ace, 2, 4 would be a "soft" hand because the hand would have a cumulative value of either seven or seventeen. In contrast, a hand composing a 10, 6, Ace is a "hard" hand because should the Ace equal "eleven", the cumulative hand value would surpass "twenty-one".

Referring back to TABLE 1, the Dealer's actions, with respect to the "Player Hand", are dictated by the Dealer's upcard. If the Dealer's upcard shows a 2, 3, 4, 5 or 6, then the "Player Hand" will not receive a successive card in addition to the Player's initially dealt hand unless the "sum" of the initial card values is less than a "hard" twelve. Moreover, the Dealer will continue to "hit" until the sum of the "Player Hand" is a "hard" twelve or higher. In contrast, if the upcard of the "Dealer Hand" shows a 7, 8, 9, 10, Face Card, or an Ace, then the "Player Hand" will not receive a successive card in addition to the Player's initially dealt hand unless the "sum" of the initial card values is less than a "hard"seventeen or a "soft" eighteen. Further, the Dealer will continue to "hit" until the sum of the "Player Hand" is a "hard" seventeen or higher, or a "soft" eighteen or higher. Incidently, a "Face Card" refers to any suit "Jack", "Queen" or "King".

Should the "Player Hand" be a "soft" hand, as set forth above, the Dealer must continue to "hit" the "Player Hand" until the sum of the "Player Hand" card values totals at least a soft eighteen. This is true regardless of the "Dealer Hand" upcard. However, in accordance with the predetermined rules of the present invention, should the "soft" hand become "hard" in the course of "hitting" the "Player Hand", the "hard" rules mentioned above apply.

It will be appreciated that the "hit" and "stand" predetermined rules pertaining to the "Player Hand" may constitute other values as well without departing from the true spirit and nature of the present invention.

To further encourage betting, several secondary betting schemes, similar to the typical secondary betting schemes of Casino Blackjack may apply to Gambler's Choice Blackjack. In the preferred embodiment, the common Player's initially dealt hand or "Player Initial Hand" may be "split" if it comprises a particular predetermined "pair" of cards. Preferably all pairs of Aces and 8's are to be automatically split by the Dealer. Subsequently, a first and a second split hand will be formed. All predetermined rules set forth above will similarly apply to the split pair, except that split aces will receive one card only. In the event of a "split", all Customers may increase their wager, in a secondary bet, by a preselected amount based on the primary bet should they choose to do so. In the preferred form, the preselected secondary "split" bet is to be equal to the primary wager. If a Customer wagering on the "Player Hand" decides not to secondarily bet, his primary wager will be based on the first split hand. Accordingly, in the event of a "split" situation, the Customer wagering on the "Dealer Hand" will have two options: (1) Keep the same bet, or; (2) Double their bet.

Alternatively, to compensate the "House" for Customers betting on the "Dealer Hand", it may be desireable to have the Customer to assume the risks associated with the Dealer. Accordingly, should the "Player Hand" be confronted with a "split" situation, the Customer wagering on the "Dealer Hand" may either secondarily wage that the "Player Hand" will lose, or surrender one-half their primary wager. Such a surrender will be termed a "reverse surrender". The surrender value may vary of course.

Additionally, in accordance with the present invention, a Customer may have the option of "doubling down" if the Player Initial Hand sums to a predetermined card value. Preferably, this predetermined value is equal to ten or eleven. In the event of this situation, the "Player Hand" will receive only one subsequent card, similar to casino Blackjack. All Customers will be given the option to increase their wager, in a secondary bet, by a preselected amount based on the primary bet should they choose to do so. In the preferred form, the preselected "double down" wager is to be equal to the primary wager. However, all Player Initial Hands of ten or eleven will receive only one subsequent card regardless of whether any individual Player doubles their bet. Similar to the "split" situation, a Customer betting the "Dealer Hand" may either keep their same bet or double their bet.

In an alternative embodiment in the "double down" situation, a Customer betting the "Dealer Hand" may secondarily bet or take the "reverse surrender" option.

The "Dealer Hand" is also played in accordance with a predetermined set of rules. Preferably, these rules correspond to the Northern Nevada Rules mentioned above. Accordingly, the Dealer must "hit" a Dealer's "hard" hand until the sum of the hand is a "hard" seventeen or greater. Should the "Dealer Hand" be "soft", they must "hit" the "Dealer Hand" until the sum of the hand is eighteen or greater.

A tie or a draw occurs when the sum of the "Player Hand" is equal to the sum of the "Dealer Hand". Should this event occur, those Customers wagering on either the "Dealer Hand" or the "Player Hand" will draw with the House while those Customers wagering on a tie will be paid according to the predetermined payout odds, preferably 9-to-1. Alternatively, those bettors wagering on either the "Dealer Hand" or the "Player Hand" would lose their wager in the event of a tie.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

Therefore, persons of ordinary skill in this field are to understand that all such equivalent structures are to be included within the scope of the following claims:

What is claimed is:

1. A method of playing a blackjack type game using at least one standard deck of fifty-two playing cards including a Dealer Hand and a Common Player Hand, said method comprising the steps of:

at least one Customer wagering a first bet on any one of a Dealer betting station corresponding to said Dealer Hand, a Player betting station corresponding to said Common Player Hand, and a tie betting station corresponding to a tie between said Dealer Hand and said Common Player Hand;

a Dealer dealing an Initial Player Hand of blackjack and an Initial Dealer Hand including a face up card;

said Dealer playing each of said Common Player Hand and said Dealer Hand in accordance with a predetermined set of rules including said Dealer first drawing successive cards for said Initial Player Hand until the sum of the combination of said successive drawn cards and the cards in said Initial Player Hand is at least equal to a first numerical value determined by the value of said face up card in said Initial Dealer Hand;

said Dealer drawing successive cards for said Initial Dealer Hand until the sum of the combination of said successive drawn cards for said Dealer Hand and the cards in said Initial Dealer Hand is at least equal to a predetermined second numerical value;

if said at least one Customer has wagered on a winning station, said Customer wins a first preselected amount based on said Customer's first bet.

2. The method of playing a blackjack type game according to claim 1 wherein, the dealt cards of the Initial Player Hand are dealt face up.

3. The method of playing a blackjack type game according to claim 1 wherein, one of the dealt cards in the Initial Dealer Hand is dealt face down and the other is dealt face up.

4. The method of playing a blackjack type game according to claim 1 wherein, where said value of said face up card of said Initial Dealer Hand is any one of a 2, 3, 4, 5 and 6, said first numerical value of said Common Player Hand must equal at least a hard "twelve".

5. The method of playing a blackjack type game according to claim 1 wherein, where said value of said face up card of said Initial Dealer Hand is any one of a 7, 8, 9, 10, a face card and an Ace, said first numerical value of said Common Player Hand must equal at least a hard "seventeen".

6. The method of playing a blackjack type game according to claim 1, wherein, where said value of said face up card of said Initial Dealer Hand is any one of a 7, 8, 9, 10, a face card and an Ace, said first numerical value of said Common Player Hand must equal at least a soft "eighteen".

7. The method of playing a blackjack type game according to claim 1 wherein, said second numerical value of said Dealer Hand equates to at least a hard "seventeen".

8. The method of playing a blackjack type game according to claim 1 wherein, said second numerical value of said Dealer Hand equates to at least a soft "eighteen".

9. The method of playing a blackjack type game according to claim 1 wherein, said Dealer splitting said Hand into a first split hand and a second split hand if said Hand comprises a pair of equal valued cards.

10. The method of playing a blackjack type game according to claim 9 further including the steps of:

said Customer wagering on said Common Player Hand wagers a second bet on said second split hand; and said Dealer dealing a second card to each of said first split hand and said second split hand.

11. The method of playing a blackjack type game according to claim 10 wherein, said second bet is of a second preselected amount based on said first bet.

12. The method of playing a blackjack type game according to claim 10 wherein, said pair of equal valued cards comprises a pair of eight's.

13. The method of playing a blackjack type game according to claim 10 wherein, said pair of equal valued cards comprises a pair of Aces.

14. The method of playing a blackjack type game according to claim 9 further including the steps of:

said Customer wagering on said Dealer Hand wagers a second bet against said second split hand;

said Customer surrendering a second preselected amount should said Customer refuse to wager said second bet against said second split hand; and said Dealer dealing a second card to each of said first split hand and said second split hand.

15. The method of playing a blackjack type game according to claim 14 wherein, said second preselected amount is one-half said first bet.

16. The method of playing a blackjack type game according to claim 1 further including the steps of:

said Customer wagering on said Common Player Hand wagers a second bet when the sum card value of said Initial Player Hand comprises a preselected third numerical value.

17. The method of playing a blackjack type game according to claim 16 wherein, said second bet is of a second preselected amount based on said first bet.

18. The method of playing a blackjack type game according to claim 16 wherein, said third numerical value equates to any one of "ten" and "eleven".

19. The method of playing a blackjack type game according to claim 1 further including the steps of:

said Customer wagering on said Dealer Hand wagers a second bet when the sum card value of said Initial Player Hand comprises a preselected third numerical value; and said Customer surrendering a second preselected amount should said Customer refuse to wager said second bet against said third numerical value.

20. The method of playing a blackjack type game according to claim 19 wherein, said second preselected amount is one-half said said first bet.

21. The method of playing a blackjack type game according to claim 19, wherein, said second bet is of a third preselected amount based on said first bet.

22. The method of playing a blackjack type game according to claim 19 wherein, said third numerical value equates to any one of "ten" and "eleven".

23. The method of playing a blackjack type game according to claim 1 wherein, said first preselected amount comprises even money with said first bet.

24. The method of playing a blackjack type game according to claim 1 wherein, said first preselected comprises 3-to-2 of said first bet when said Initial Player Hand is a blackjack.

25. The method of playing a blackjack type game according to claim 1 wherein, said first preselected amount comprises 9-to-1 of said first bet for said tie bets.

26. The method of playing a blackjack type game according to claim 1 wherein, said first preselected amount comprises 5-to-6 of said first bet for wagers on said Dealer Hand.

27. A method of playing a blackjack type game using at least one standard deck of fifty-two playing cards including a Dealer Hand and at least two Common Player Hands, said method comprising the steps of:

at least one Customer wagering a first bet on any one of a Dealer betting station corresponding to said Dealer Hand, Player betting station corresponding to one of said at least two Common Player Hands, and a tie betting station corresponding to a tie between said Dealer Hand and one of said at least two Common Player Hands;

a Dealer dealing an Initial Player Hand of blackjack to each of said at least two Common Player Hands and an Initial Dealer Hand including a face up card;

said Dealer playing each of said at least two Common Player Hands and said Dealer Hand in accordance with a predetermined set of rules including said Dealer first drawing successive cards for each said Initial Player Hand until the sum of the combination of said successive drawn cards and the cards in each said Initial Player Hand is at least equal to a first numerical value determined by the value of said face up card in said Initial Dealer Hand;

said Dealer drawing successive cards for said Initial Dealer Hand until the sum of the combination of said successive drawn cards for said Dealer Hand and the cards in said Initial Dealer Hand is at least equal to a predetermined second numerical value;

if said at least one Customer has wagered on a winning station, said Customer wins a first preselected amount based on said Customer's first bet.

28. The method of playing a blackjack type game according to claim 27 wherein, where said value of said face up card of said Initial Dealer Hand is any one of a 2, 3, 4, 5 and 6, said first numerical value of each said Common Player Hand must equal at least a hard "twelve".

29. The method of playing a blackjack type game according to claim 27 wherein, where said value of said face up card of said Initial Dealer Hand is any one of a 7, 8, 9, 10, a face card and an Ace, said first numerical value of each said Common Player Hand must equal at least a hard "seventeen".

30. The method of playing a blackjack type game according to claim 27 wherein, where said value of said face up card of said Initial Dealer Hand is any one of a 7, 8, 9, 10, a face card and an Ace, said first numerical value of each said Common Player Hand must equal at least a soft "eighteen".

31. The method of playing a blackjack type game according to claim 27 wherein, said second numerical value of said Dealer Hand equates to at least a hard "seventeen".

32. The method of playing a blackjack type game according to claim 27 therein, said second numerical value of said Dealer Hand equates to at least a soft "eighteen".

33. A method of playing a blackjack type game using at least one standard deck of fifty-two playing cards including a Dealer Hand and a Common Player Hand, said method comprising the steps of:

at least one Customer wagering a first bet on any one of a Dealer betting station corresponding to said Dealer Hand, a Player betting station corresponding to said Common Player Hand, and a tie betting station corresponding to a tie between said Dealer Hand and said Common Player Hand;

a Dealer dealing an Initial Player Hand of blackjack and an Initial Dealer Hand including a face up card;

said Dealer playing each of said Common Player Hand and said Dealer Hand in accordance with a predetermined set of rules including said Dealer first drawing successive cards for said Initial Player Hand until the sum of said successive drawn cards and the cards in said Player Initial Hand is at least equal to a hard 12 if said dealt face up card of said Dealer Hand is any one of a 2, 3, 5, 5 and 6;

if said at least one Customer has wagered on a winning station, said Customer wins a first preselected amount based on said Customer's first bet.

34. A method of playing a blackjack type game using at least one standard deck of fifty-two playing cards including a Dealer Hand and a Common Player Hand, said method comprising the steps of:

at least one Customer wagering a first bet on any one of a Dealer betting station corresponding to said Dealer Hand, a Player betting station corresponding to said Common Player Hand, and a tie betting station corresponding to a tie between said Dealer Hand and said Common Player Hand;

a Dealer dealing an Initial Player Hand of blackjack and an Initial Dealer Hand including a face up card;

said Dealer playing each of said Common Player Hand and said Dealer Hand in accordance with a predetermined set of rules including said Dealer first drawing successive cards for said Initial Player Hand until the sum of said successive drawn cards and the cards in said Player Initial Hand is at least equal to a hard 17 if said dealt face up card of said Dealer Hand is any one of a 7, 8, 9, 10, a face card and an Ace;

if said at least one Customer has wagered on a winning station, said Customer wins a first preselected amount based on said Customer's first bet.

35. A method of playing a blackjack type game using at least one standard deck of fifty-two playing cards including a Dealer Hand and a Common Player Hand, said method comprising the steps of:

at least one Customer wagering a first bet on any one of a Dealer betting station corresponding to said Dealer Hand, a Player betting station corresponding to said Common Player Hand, and a tie betting station corresponding to a tie between said Dealer Hand and said Common Player Hand;

a Dealer dealing an Initial Player Hand of blackjack and an Initial Dealer Hand including a face up card;

said Dealer playing each of said Common Player Hand and said Dealer hand in accordance with a predetermined set of rules including said Dealer first drawing successive cards for said Initial Player Hand until the sum of said successive drawn cards and the cards in said Player Initial Hand is at least equal to a soft 18 if said dealt face up card of said Dealer Hand is any one of a 7, 8, 9, 10, a face card and an Ace;

if said at least one Customer has wagered on a winning station, said Customer wins a first preselected amount based on said Customer's first bet.

* * * * *